US006695662B2

(12) United States Patent
Kelley

(10) Patent No.: US 6,695,662 B2
(45) Date of Patent: Feb. 24, 2004

(54) SURFING CRAFT WITH REMOVABLE FIN

(76) Inventor: Benjamin D. Kelley, 882 Home Ave., Carlsbad, CA (US) 92008

( * ) Notice: Subject to any disclaimer, the term of this patent is extended or adjusted under 35 U.S.C. 154(b) by 0 days.

(21) Appl. No.: 10/005,971

(22) Filed: Nov. 7, 2001

(65) Prior Publication Data

US 2003/0087564 A1 May 8, 2003

(51) Int. Cl.[7] ..... B63B 1/00
(52) U.S. Cl. ..... 441/79; 441/74
(58) Field of Search ..... 441/79, 74; 114/127, 114/129, 138, 140, 141; 403/321, 325, 326, 327, 329

(56) References Cited

U.S. PATENT DOCUMENTS

| | | | | | |
|---|---|---|---|---|---|
| 3,585,663 | A | * | 6/1971 | Johnson | 441/79 |
| 4,044,416 | A | * | 8/1977 | Brewer et al. | 441/79 |
| 4,398,485 | A | * | 8/1983 | Diziere | 114/132 |
| 4,421,492 | A | * | 12/1983 | Leva | 441/79 |
| 4,804,347 | A | * | 2/1989 | Ross | 441/79 |
| 4,805,546 | A | * | 2/1989 | Geller et al. | 114/132 |
| 5,062,378 | A | * | 11/1991 | Bateman | 114/274 |
| 5,215,488 | A | * | 6/1993 | Bailey | 441/79 |
| 5,464,359 | A | | 11/1995 | Whitty | |
| 5,672,080 | A | * | 9/1997 | Gauthier | 440/27 |
| 5,934,962 | A | | 8/1999 | Daum | |
| 5,934,963 | A | * | 8/1999 | Frizzell | 441/79 |

FOREIGN PATENT DOCUMENTS

| | | | | |
|---|---|---|---|---|
| AU | 491811 | * | 3/1977 | 441/79 |
| FR | 2598673 | * | 11/1987 | 441/79 |
| WO | WO 90/13472 | * | 11/1990 | 441/79 |
| WO | WO 00/09222 | * | 2/2000 | 441/79 |

* cited by examiner

*Primary Examiner*—S. Joseph Morano
*Assistant Examiner*—Ajay Vasudeva
(74) *Attorney, Agent, or Firm*—John R. Ross; John R. Ross, III

(57) ABSTRACT

A surfing craft with removable fin. A removable fin is disposed in a fin box and the fin box is disposed in a surfing craft body. A releasable locking mechanism has a spring actuated locking arm, a locking tab and an indention. The spring actuated locking arm applies spring force for locking the locking tab into the indention. A counter force is applied to the spring actuated locking arm to remove the fin from the fin box. In one preferred embodiment, the locking tab is attached to the locking arm and the locking arm is bendably connected to the fin. In this preferred embodiment the indention is on the fin box and the locking arm's locking tab is engaged with the indention of the fin box to prevent the fin from disconnecting from the fin box. Also in this preferred embodiment, by applying finger force the locking arm is bent causing the locking tab to disengage the indention so that the fin can be removed.

26 Claims, 9 Drawing Sheets

SURFING CRAFT WITH REMOVABLE FIN

BACKGROUND OF THE INVENTION

Surfing is an extremely old sport. Lieutenant James King, serving under Captain James Cook during his third expedition to the Pacific, in 1779 wrote what is recognized as the first known written description of the surfing ever recorded by Western man. Referring to the locals at Kealakekua Bay on the Kona coast of the Big Island of Hawaii, King writes:

> Whenever, from stormy weather, or any extraordinary swell at sea, the impetuosity of the surf is increased to its utmost heights, they choose that time for this amusement: twenty or thirty of the natives, taking each a long narrow board, rounded at the ends, set out together from the shore. . . . As the surf consists of a number of waves, of which every third is remarked to be always much larger than the others, and to flow higher on the shore, the rest breaking in the intermediate space, their first object is to place themselves on the summit of the largest surge, by which they are driven along with amazing rapidity toward the shore.

Since the time of the ancient Hawaiians, surfing has evolved considerably. While the Hawaiians rode wooden surfboards that could weigh as much as 175 pounds, in contrast, modern surfboards are much smaller, lighter and more maneuverable.

Modern surfboards are rarely made of solid wood. Instead, a modern surfboard is usually made of shaped and sanded foam that has been covered with one or more layers of fiberglass. For example, FIG. 1 shows a typical prior art modern surfboard 10. A body of shaped plastic foamed material 11 is covered with a layer of fiber-reinforced resin 12, preferably fiberglass, and has one or more fins which are supported in a rectangular box called a fin box. On some surfboards, the fins are "glassed on" for support.

Method of Fin Attachment

Glassing the Fins

Glassing the fins onto a surfboard refers to the act of attaching the fins to the board by means of a fiber-reinforced resin around the base of the fin. There are significant disadvantages to glassing the fins onto the surfboard. Labor costs can be high and subsequent sanding and finishing of the board can be difficult. Also, once the fin is glassed on, it cannot be adjusted or replaced. Hence, transporting a surfboard with glassed on fins can be difficult. For example, if the fin is bumped or hit it can break off or crack the fiberglass, ruining the whole surfboard.

Fin Boxes

In the use of the fin box, a rectangular cavity is formed in the board by the use of a router and the fin box is inserted into this cavity. FIG. 2 shows a side cross section view of fin box 14 shown in FIG. 1. Fin box 14 is initially secured inside the cavity in foamed material 11 by an adhesive and then further secured by fiber-reinforced resin layer 12. Fin 13 is inserted inside fin box 14 and secured into fin box 14 by means of screw 15. To remove fin 13 from fin box 14, the surfer has to unscrew screw 15 with a screwdriver.

There are significant disadvantages to prior art fin boxes. For example, the screw can corrode due to long term exposure to salt water. Or the screw can loosen over time, allowing the fin to fall out and become lost. Also, because a tool is required to remove the fin, a surfer who does not have a screwdriver with him will be unable to remove his fin.

Whereas ancient Hawaiians surfed primarily for pleasure or social status, modern surfing can be extremely competitive. Surfing competitions are held throughout the world with world wide television coverage and large cash prizes. Also, valuable endorsement contracts are rewarded to the best surfers.

Competitive surfers are looking for an advantage over the field to increase their odds of winning. The board and fin types chosen by the surfer are very important. Based on the wave conditions, one type of fin may be preferable over another type. Currently, it is difficult for the surfer to quickly switch fins. He is forced to find a screwdriver, unscrew the current fin, and screw in the new fin.

What is needed is a better way of mounting fins into a fin box.

SUMMARY OF THE INVENTION

The present invention provides a surfing craft with removable fin. A removable fin is disposed in a fin box and the fin box is disposed in a surfing craft body. A releasable locking mechanism has a spring actuated locking arm, a locking tab and an indention. The spring actuated locking arm applies spring force for locking the locking tab into the indention. A counter force is applied to the spring actuated locking arm to remove the fin from the fin box. In one preferred embodiment, the locking tab is attached to the locking arm and the locking arm is bendably connected to the fin. In this preferred embodiment the indention is on the fin box and the locking arm's locking tab is engaged with the indention of the fin box to prevent the fin from disconnecting from the fin box. Also in this preferred embodiment, by applying finger force the locking arm is bent causing the locking tab to disengage the indention so that the fin can be removed.

DETAILED DESCRIPTION OF THE PREFERRED EMBODIMENTS

First Preferred Embodiment

Figure 6:
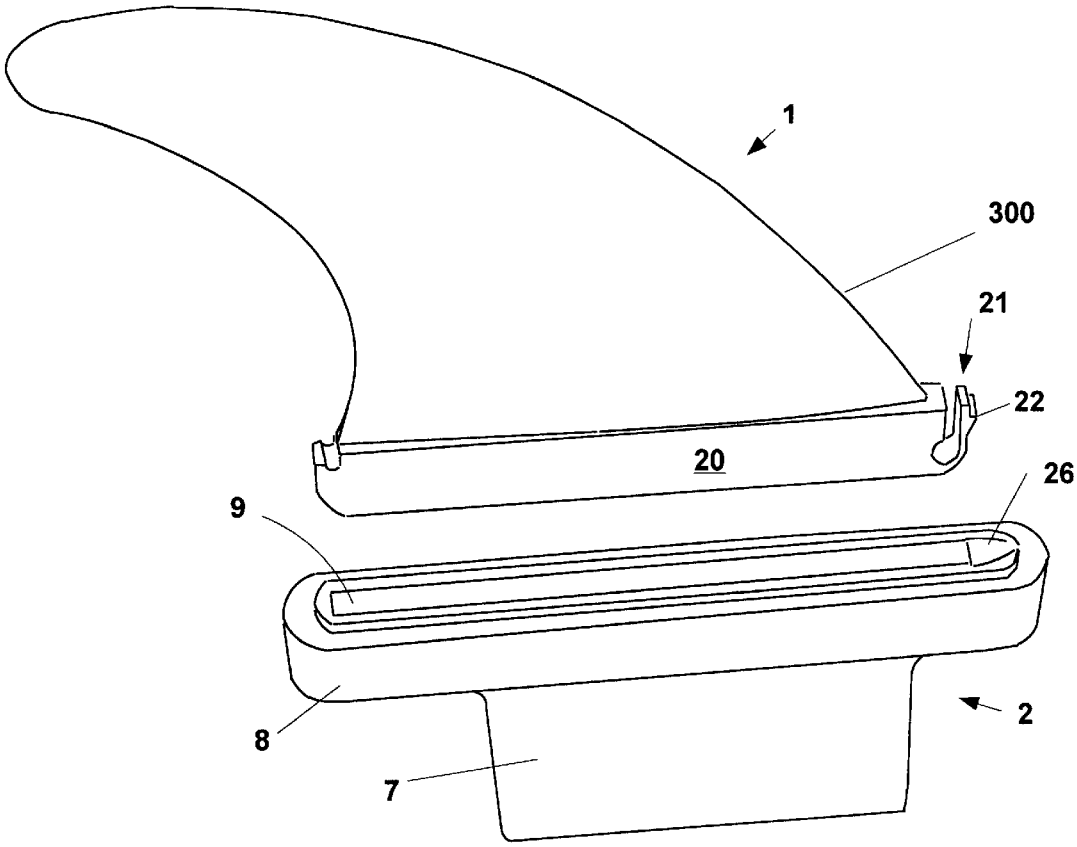
FIG. 6 shows a perspective view of a preferred embodiment of the present invention.
Figure 7:
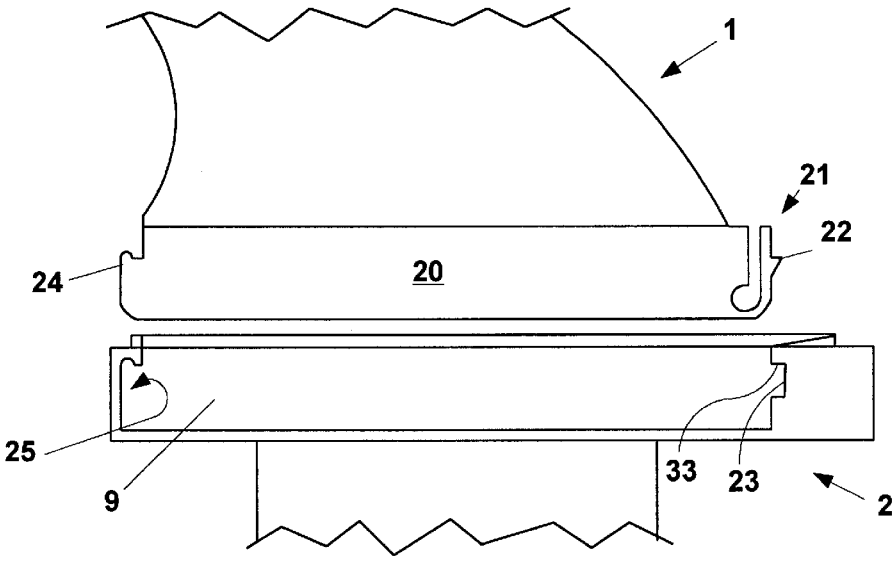
FIGS. 7–11 show a sequence depicting the attachment of a preferred fin to a preferred fin box.

FIG. 6 shows a perspective view and FIG. 7 shows a side view of surfboard fin 1 positioned over fin box 2. Preferably, fin box 2 has upper portion 8 and tab 7. Tab 7 functions to secure fin box 2 inside the surfboard's foam material. In the preferred embodiment, fin 1 is inserted into fin box 2 by inserting base 20 into cavity 9. FIG. 7 shows a cross section side view of cavity 9. Tongue portion 24 is first inserted into socket 25, then the opposite end of base 20 is pressed into cavity 9. Inserting fin 1 into fin box 2 causes flexible locking arm 21 to bend towards base 20 until spring force snaps locking tab 22 back into a locked position in indention 23. Once inserted, the upper edge of locking tab 22 rests flush under overhanging edge 33 of indention 23 to prevent fin 1 from falling out of fin box 2. To remove fin 1 from fin box 2, the surfer merely presses against the upper portion of locking arm 21 with his finger. This counter force causes locking arm 21 to bend and locking tab 22 to clear edge 33. The surfer can then easily pull upward on fin 1 to remove it from fin box 2. By utilization of the present invention, a surfing fin can be inserted and removed quickly and easily from its fin box without the use of any tools other than the surfer's own hands.

Mounting the Fin Box into the Surfboard

FIGS. 3A–5B show a preferred method for mounting fin box 2 into a surfboard.

Figure 1:
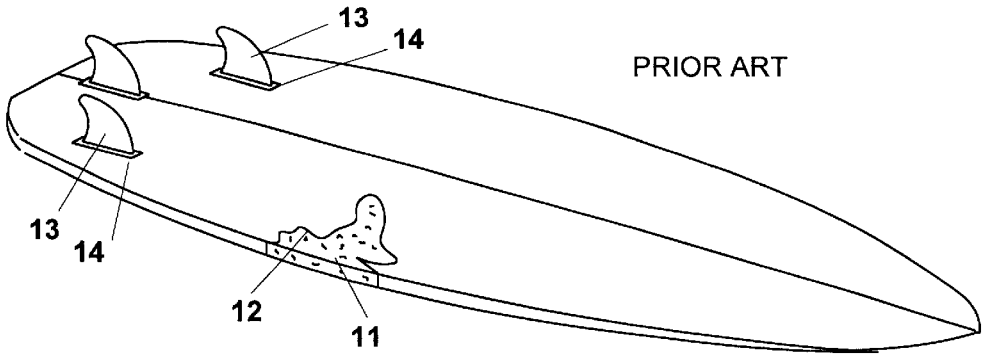
FIG. 1 shows a prior art surfboard.
Figure 2:
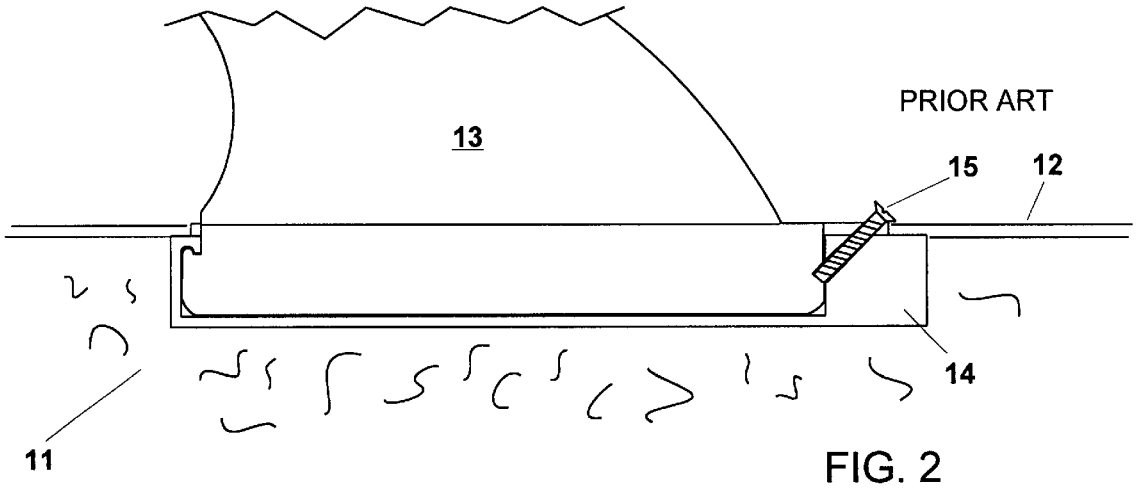
FIG. 2 shows details of the fin box of the prior art surfboard of FIG. 1.
Figure 3A:
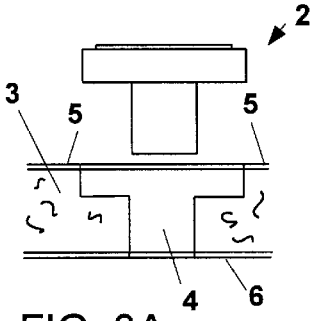
FIGS. 3A–5B show a sequence depicting the installation of a preferred fin box into the body of a preferred surfboard.
Figure 3B:
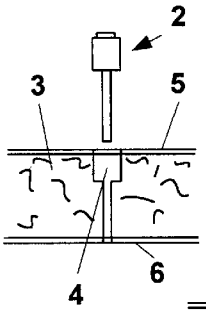

FIG. 3A shows a side view of a preferred fin box 2 positioned over shaped plastic foam material 3. Preferably, plastic foam material 3 has been shaped and sanded into the form of a surfboard, such as that depicted in FIG. 1. Fiberglass layers 5 and 6 have been applied. FIG. 3A also shows a cross section side view of cavity 4. Cavity 4 has been cut by the use of a router to conform to the shape of fin box 2. FIG. 3B shows a cross section front view that corresponds to the side view depicted in FIG. 3A.

Figure 4A:
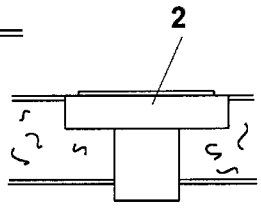
Figure 4B:
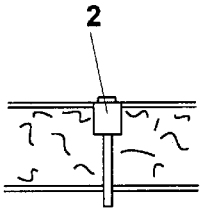

FIGS. 4A and 4B show fin box 2 inserted into cavity 4 (FIGS. 3A and 3B). Preferably, fin box 2 is secured inside cavity 4 with an adhesive.

Figure 5A:
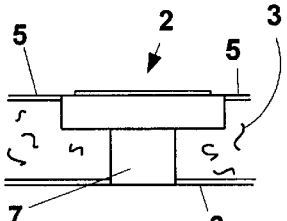
Figure 5B:
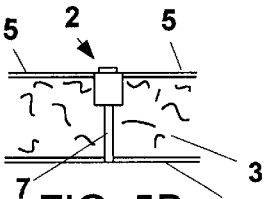

FIGS. 5A and 5B show the bottom portion of tab 7 sanded so that it is approximately flush with the bottom of fiberglass layer 6.

Inserting the Fin into the Fin Box

FIGS. 7–11 show a sequence illustrating how fin 1 is inserted inside fin box 2.

In FIG. 7, fin 1 is positioned over cavity 9 of fin box 2.

Figure 8:
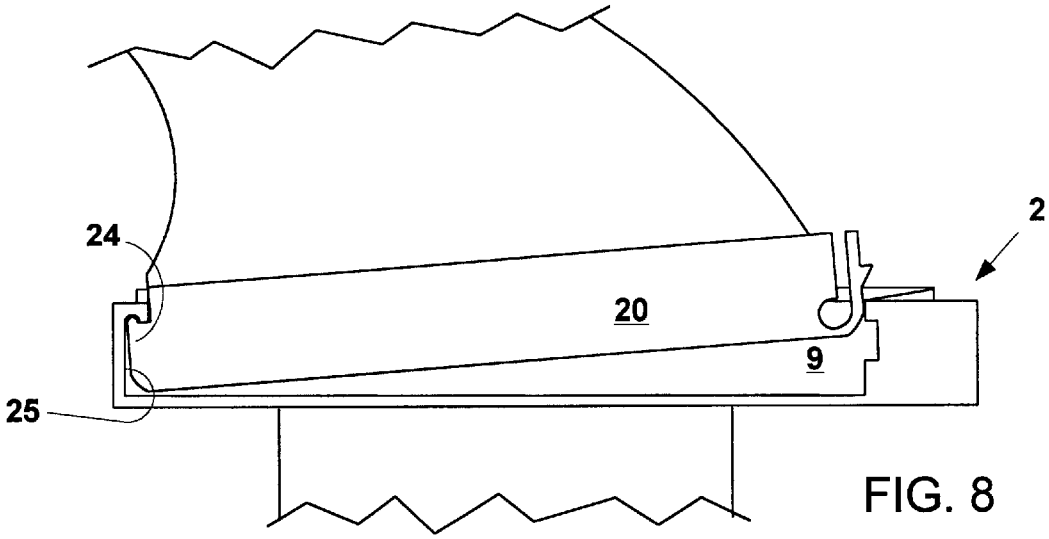

In FIG. 8, base portion 20 of fin 1 has been inserted inside cavity 9 at an angle. Tongue 24 has been inserted into socket 25.

Figure 9:
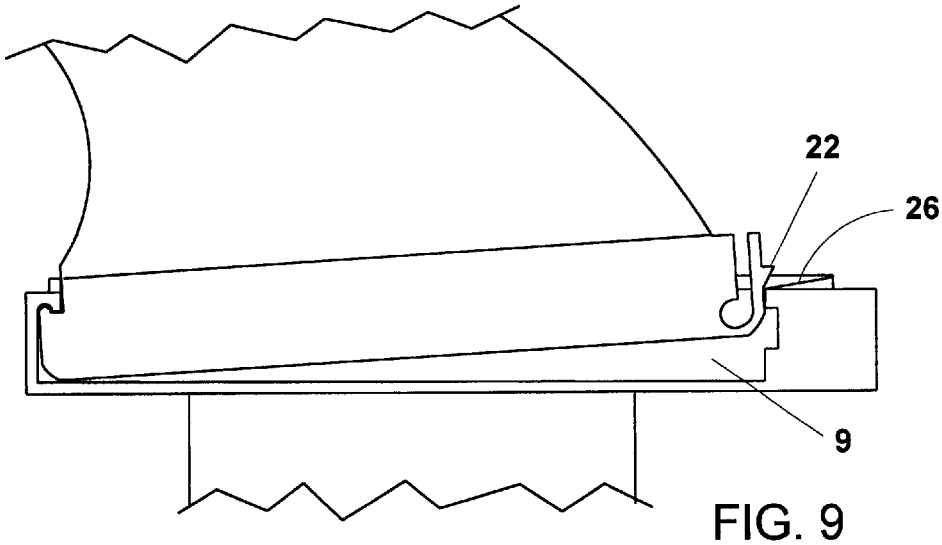

In FIG. 9, fin 1 has been lowered further into cavity 9 so that locking tab 22 is in contact with edge of ramp 26. A perspective view of ramp 26 is shown in FIG. 6.

Figure 10:
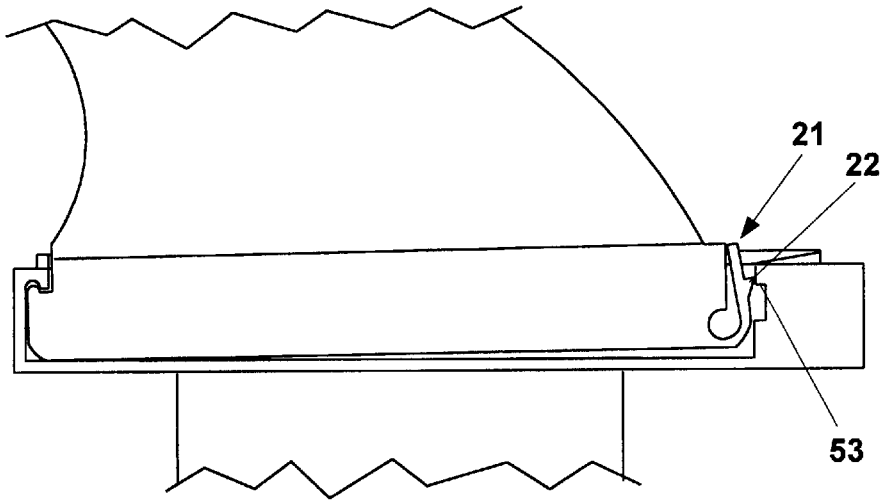

In FIG. 10, fin 1 has been lowered further into cavity 9. Locking tab 22 pressing against lip 53 has caused locking arm 21 to bend, allowing for further downward movement of fin 1. In the first preferred embodiment, base 20 is made out of a fiberglass reinforced composite plastic. Fiberglass reinforced composite plastic is a material that is strong enough to provide good support for fin 1, yet ductile so that locking arm 21 can be bent by applying finger force to its upper portion (see also FIG. 12).

Figure 11:
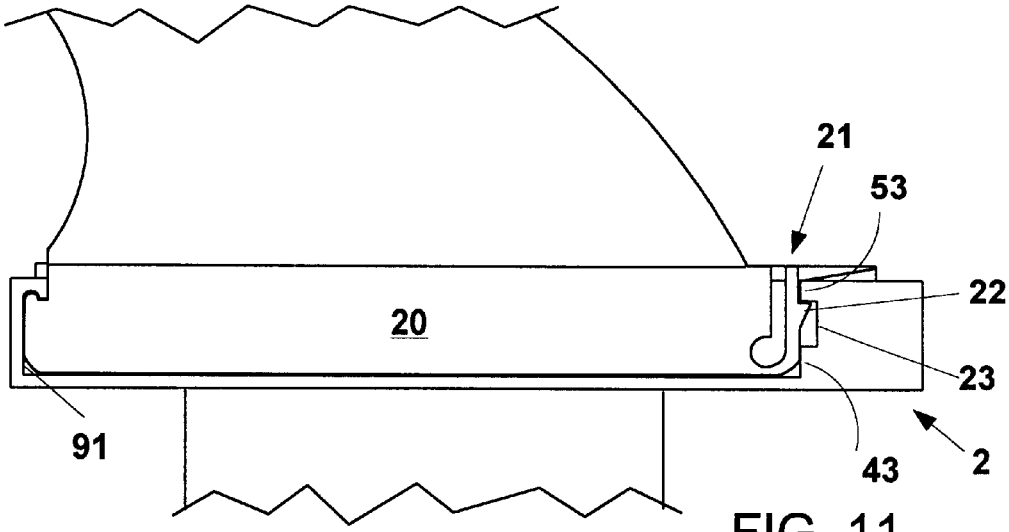

In FIG. 11, base 20 of fin 1 is fully inserted into fin box 2. The bending of locking arm 21 (shown in FIG. 10) creates a spring force. The spring force causes locking arm 21 to snap back to its upright position after locking tab 22 clears lip 53. The upper edge of locking tab 22 rests flush against the upper horizontal edge of grove 23 to prevent fin 1 from moving upward, thereby firmly securing fin 1 inside fin box 2. In the first preferred embodiment, unwanted lateral motion is resisted by the mating of tongue 24 with socket 25, the abutment of locking arm 21 against lips 43 and 53, and by the abutment of base 20 against edge 91 of fin box 2.

Removing the Fin from the Fin Box

Figure 12:
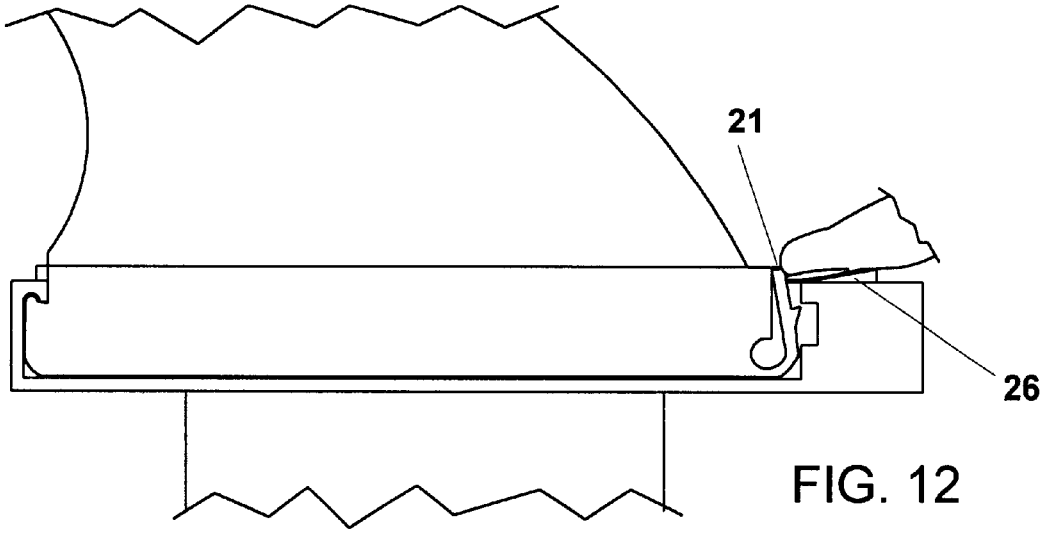
FIGS. 12–14 show a sequence depicting the removal of a preferred fin from a preferred fin box.
Figure 13:
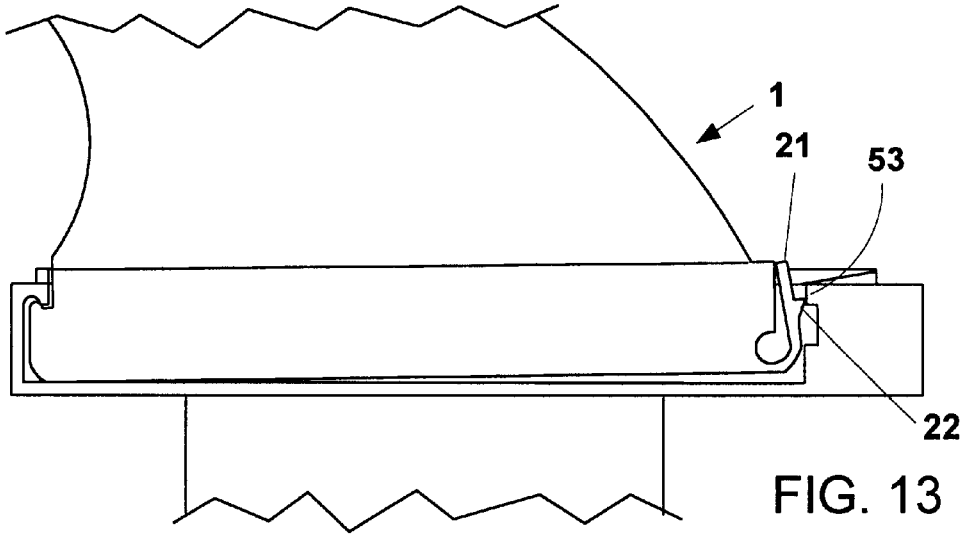
Figure 14:
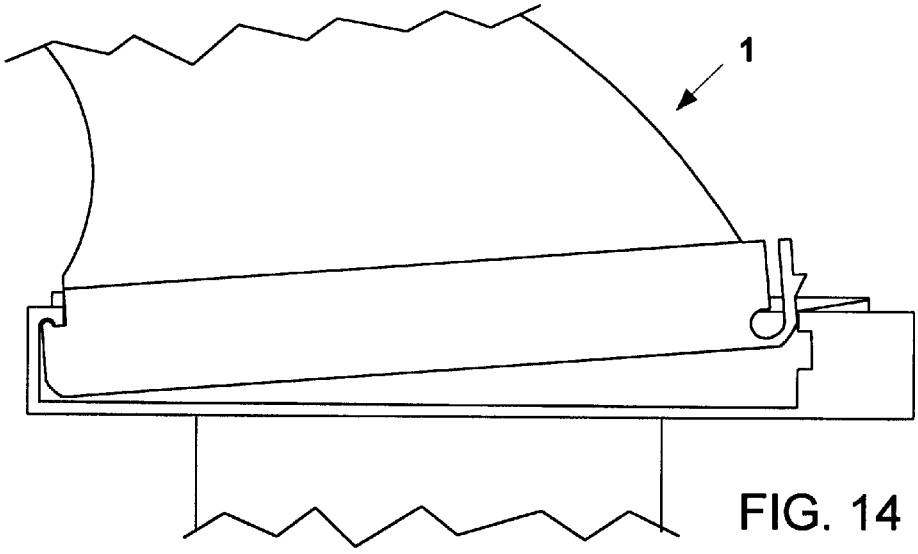

FIGS. 12–14 show a sequence illustrating how fin 1 is removed from fin box 2.

In FIG. 12, the surfer has overcome the spring force by the application of a counter force to locking arm 21. He has slid his finger along ramp 26 and has pressed locking arm 21 so that it bends, allowing for upward movement of fin 1.

In FIG. 13, fin 1 has been lifted up at an angle. Lip 53 is pressing against locking tab 22 so that locking arm 21 is still bent.

In FIG. 14, fin 1 has been lifted further upward at an angle. The surfer may now completely remove the fin from the fin box so that it is in the position shown in FIGS. 6 and 7.

Second Preferred Embodiment

Figure 15:
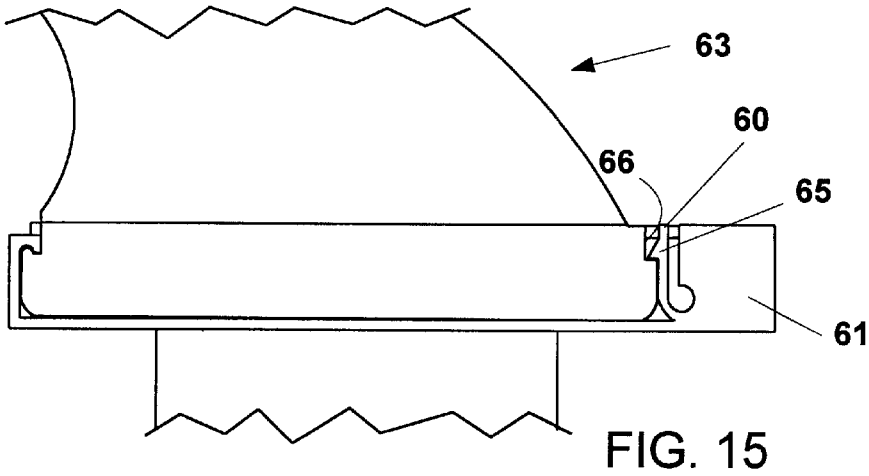
FIGS. 15–16 show another preferred embodiment.
Figure 16:
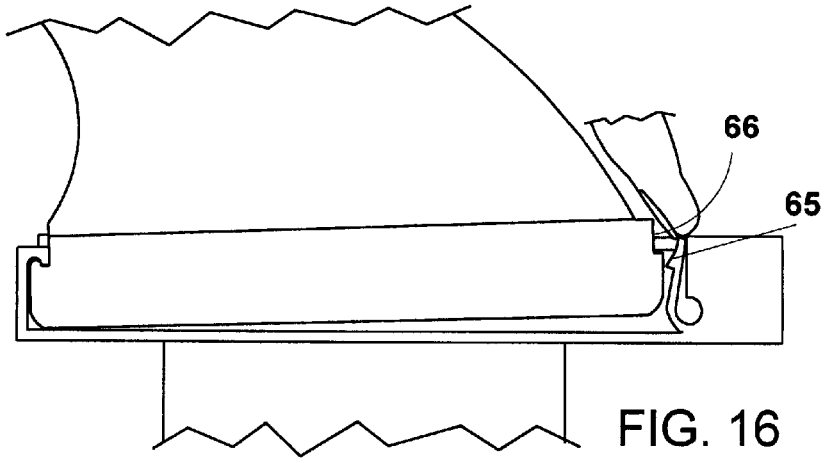

A second preferred embodiment is shown in FIGS. 15 and 16. In the second preferred embodiment, locking arm 60 is connected to fin box 61. Fin 63 is installed in a fashion similar to that described above in reference to the first preferred embodiment. As fin 63 is lowered into fin box 61, locking arm 60 bends allowing fin 63 to be inserted inside fin box 61.

In FIG. 15, fin 63 is fully inserted inside fin box 61. Locking arm 60 has snapped back to its upright position. The lower horizontal edge of locking tab 65 is adjacent the horizontal edge indention 66 to prevent fin 63 from moving upward, thereby firmly securing fin 63 inside fin box 61.

In FIG. 16, the surfer has bent locking arm 60 by pressing against its upper portion with his finger. Locking tab 65 has been cleared from indention 66, enabling the surfer to remove the fin.

Third Preferred Embodiment

Figure 17:
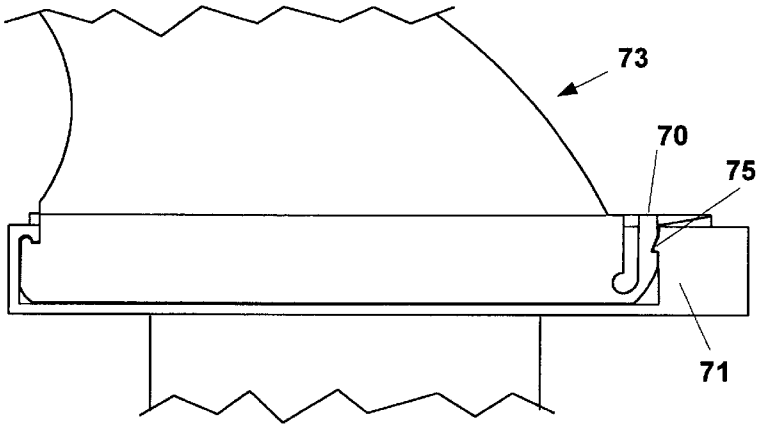
FIGS. 17–18 show another preferred embodiment.
Figure 18:
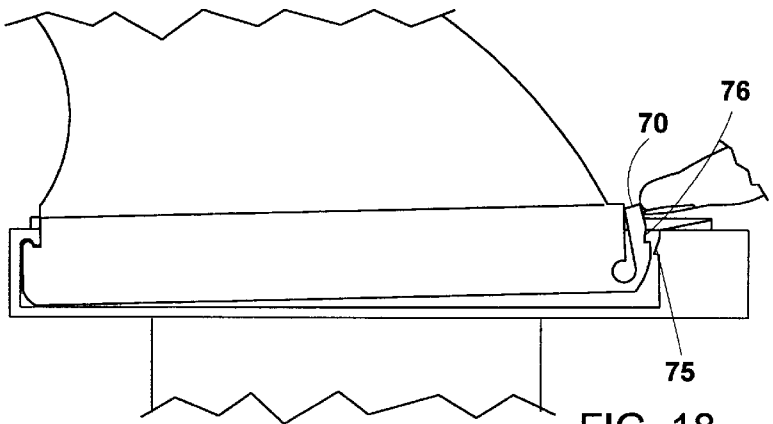

A third preferred embodiment is shown in FIGS. 17 and 18. In the third preferred embodiment, locking arm 70 is connected to fin 73. Fin 73 is installed in a fashion similar to that described above for the earlier preferred embodiments. As fin 73 is lowered into fin box 71, locking arm 70 bends allowing fin 73 to be inserted inside fin box 71.

In FIG. 17, fin 73 is fully inserted inside fin box 71. Locking arm 70 has snapped back to its upright position. The lower horizontal edge of locking tab 75 is adjacent the horizontal edge of indention 76 to prevent fin 73 from moving upward, thereby firmly securing fin 73 inside fin box 71.

In FIG. 18, the surfer has bent locking arm 70 by pressing against its upper portion with his finger. Indention 76 has been cleared from locking tab 75, enabling the surfer to remove the fin.

Fourth Preferred Embodiment

Figure 19:
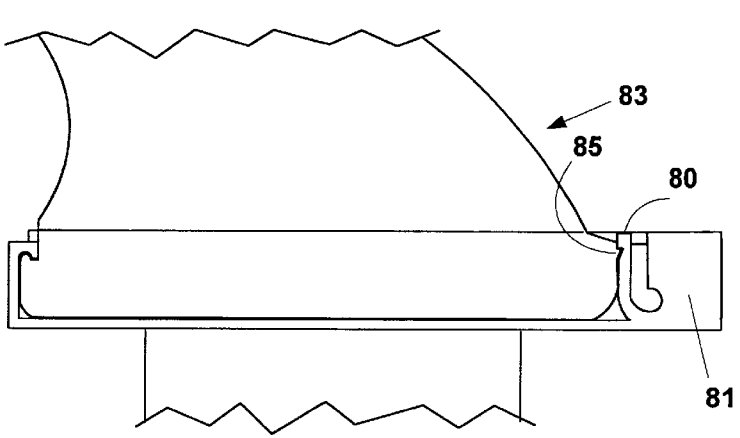
FIGS. 19–20 show another preferred embodiment.
Figure 20:
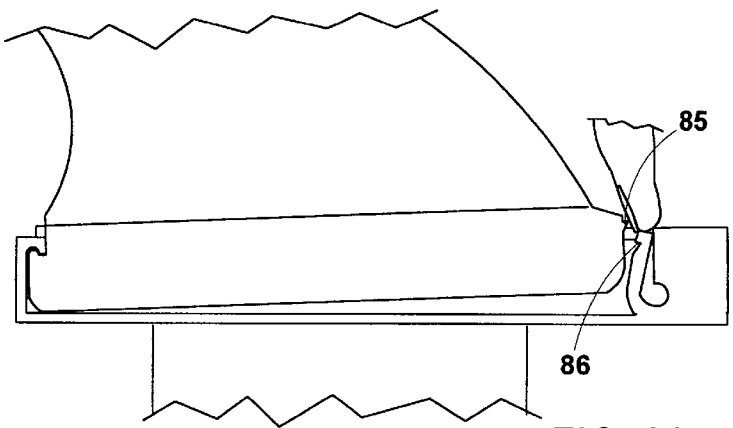

A fourth preferred embodiment is shown in FIGS. 19 and 20. In the fourth preferred embodiment, locking arm 80 is connected to fin box 81. Fin 83 is installed in a fashion similar to that described above for the earlier preferred embodiments. As fin 83 is lowered into fin box 81, locking arm 80 bends allowing fin 83 to be inserted inside fin box 81.

In FIG. 19, fin 83 is fully inserted inside fin box 81. Locking arm 80 has snapped back to its upright position. The upper horizontal edge of locking tab 85 is adjacent the horizontal edge of indention 86 to prevent fin 83 from moving upward, thereby firmly securing fin 83 inside fin box 81.

In FIG. 20, the surfer has bent locking arm 80 by pressing against its upper portion with his finger. Indention 86 has been cleared from locking tab 85, enabling the surfer to remove the fin.

Fifth Preferred Embodiment

Although each of the above preferred embodiments disclosed a locking arm that could be bent by apply finger force pressure, it would also be possible to have other types of locking arms. For example, in another preferred embodiment shown in FIGS. 21–24, locking arm 121 is pivotally attached to the base 120. Spring 128 urges clockwise rotation of locking arm 121.

Figure 21:
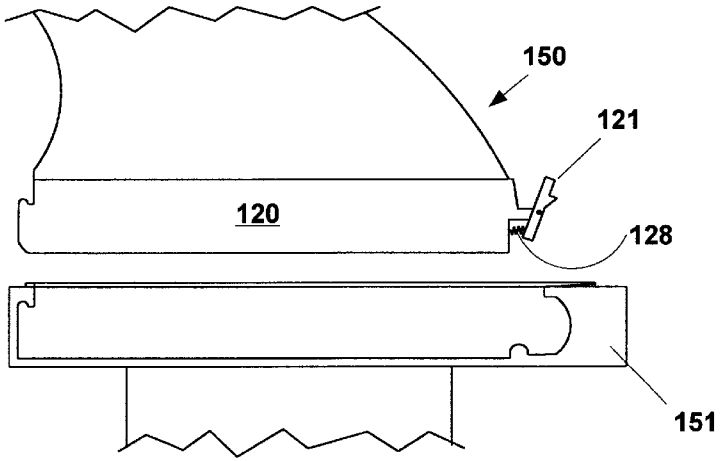
FIGS. 21–24 show another preferred embodiment.

In FIG. 21, fin 150 is positioned above base 151.

Figure 22:
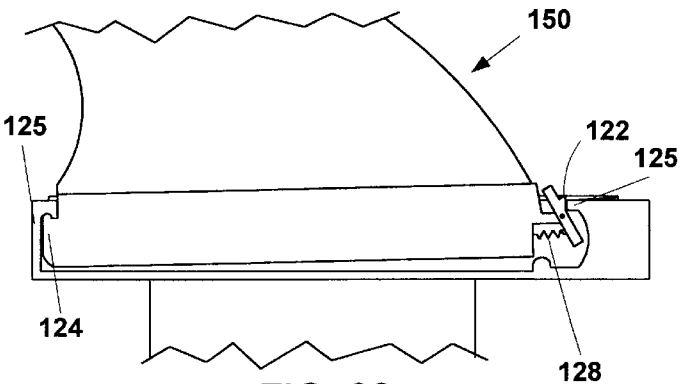

In FIG. 22, base portion 120 of fin 150 has been inserted inside fin box 151 at an angle. Tongue 124 has been inserted into socket 125. Locking tab 122 pressing against lip 125 has caused locking arm 121 to rotate counterclockwise and has expanded spring 128.

Figure 23:
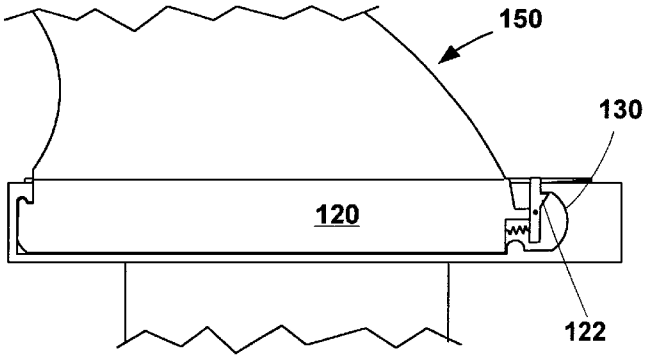

In FIG. 23, base 120 of fin 150 is fully inserted into fin box 151. Spring 128 has snapped locking arm 121 to an upright position. The upper edge of locking tab 122 rests flush against the upper horizontal edge of grove 130 to prevent fin 150 from moving upward, thereby firmly securing fin 150 inside fin box 151.

Figure 24:
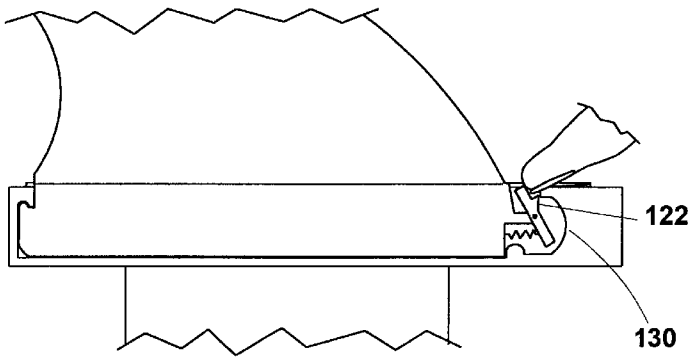

In FIG. 24, the surfer has pressed the upper portion of locking arm 121 with his finger. Locking tab 122 has been cleared from indention 130, enabling the surfer to remove the fin.

Figure 25:
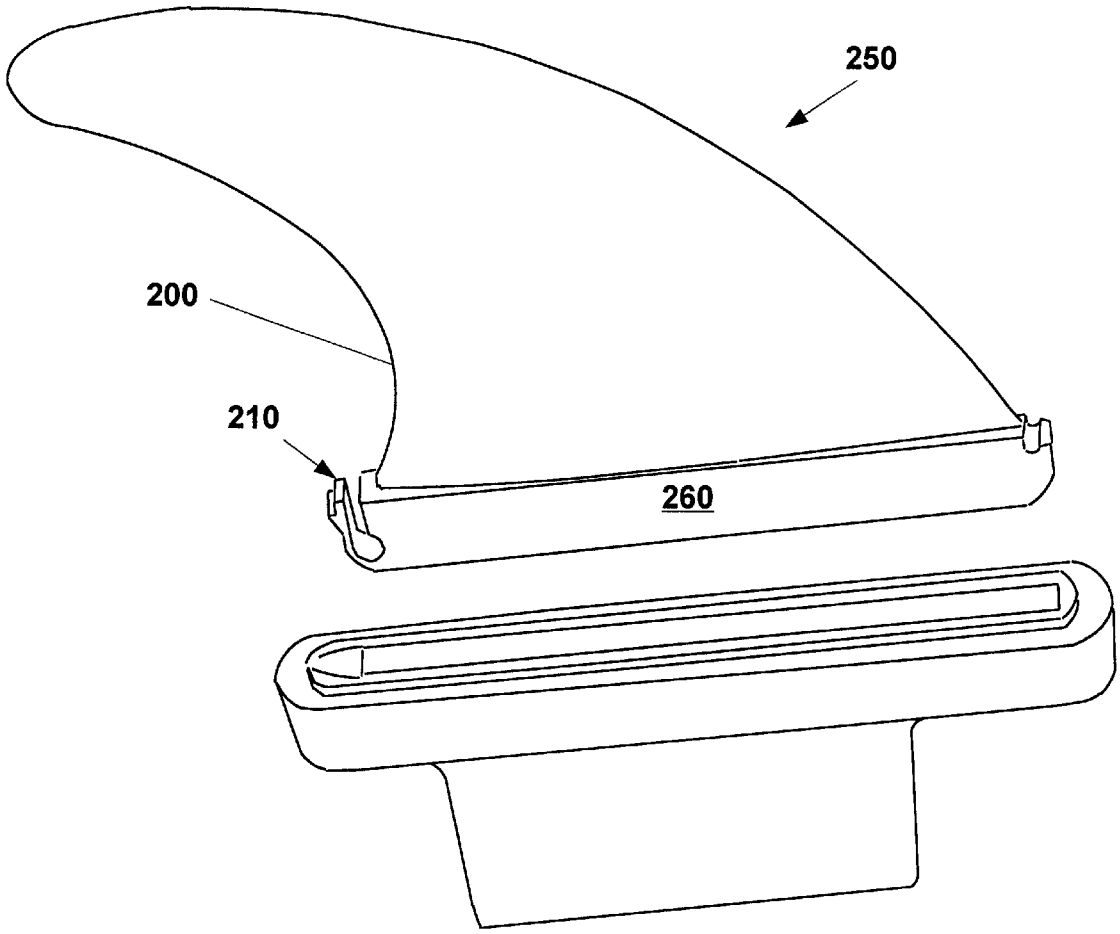
FIG. 25 shows another preferred embodiment of the present invention.
Figure 26:
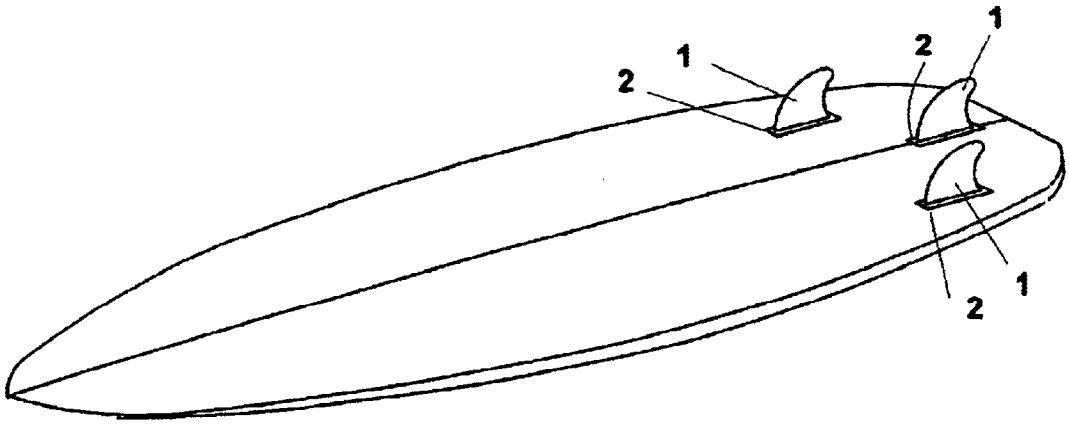
FIG. 26 shows a preferred embodiment of the present invention.

Although the above-preferred embodiments have been described with specificity, persons skilled in this art will recognize that many changes to the specific embodiments disclosed above could be made without departing from the spirit of the invention. For example, although specific fin boxes were shown in the above discussed preferred embodiments, it would be possible to utilize a variety of other fin boxes other than the fin boxes shown. For example, it would be possible to make fin box 2 without tab 7. Also, although the above-preferred embodiments discussed a "surfer" removing and installing the fin inside the fin box, other individuals besides a surfer would benefit from the present invention. For example, individuals who sale surfboards and individuals who transport surfboards would find the present invention very useful. Also, the present invention can be utilized on surfing crafts other than surfboards. For example, it could be utilized on other surfing crafts in which fins are attached (such as a wind surfer). Wind surfers have, in addition to the board and at least one fin., a mast and sail that the rider can manipulate for propulsion. Also, although the above preferred embodiments disclosed using finger force to bend the locking arm, it would be possible to bend the locking arm with other objects besides a finger. For example, as locking arm 21 is made more rigid, the amount of force necessary to bend it becomes greater. For a very rigid locking arm 21 (FIG. 6), or for a very tight spring 128 (FIGS. 21–24), a hand tool (for example, a rock with a flat edge) could be used to apply force directly to the locking arm. Also, although FIG. 6 shows locking arm 21 attached to base 20 at leading edge 300 of fin 1, it would also be possible to attach the locking arm to the trailing edge. For example, FIG. 25 shows locking arm 210 attached to base 260 at trailing edge 200 of fin 250. Also, the present invention can be used on surfing craft having just one fin or on a surfing craft having multiple fins. For example, FIG. 26 shows surfboard 133 having three fins 1 inserted in three fin boxes 2. Therefore, the attached claims and their legal equivalents should determine the scope of the invention.

I claim:

1. A surfing craft with removable fin, comprising:

A) a surfing craft body,

B) a fin box disposed in said surfing craft body,

C) a removable fin disposed in said fin box, and

D) a releasable locking mechanism, comprising 1) a locking tab, 2) an indention, and 3) a bendable spring actuated locking arm, wherein said spring actuated locking arm is for applying a spring force locking said locking tab into said indention, said bendable spring actuated locking arm comprising:

a. a finger receiving end, and b. an attached end, wherein said locking tab is removable from said indention by pressing said spring actuated locking arm with a finger at said finger receiving end causing said bendable spring actuated locking arm to bend at said attached end and causing said spring actuated locking arm to overcome said spring force.

2. The surfing craft as in claim 1, wherein said locking tab is located on said fin and said indention is located on said fin box.

3. The surfing craft as in claim 1, wherein said locking tab is located on said fin box and said indention is located on said fin.

4. The surfing craft as in claim 1, wherein said fin box further comprises a stabilizing tab for better securing said fin box into said surfing craft body.

5. The surfing craft as in claim 1, wherein said locking arm is bendably attached to either one of said fin or said fin box.

6. The surfing craft of claim 1, wherein said bendable locking arm is a pivoting locking arm and wherein said pivoting locking arm is pivotally attached to either one of said fin or said fin box.

7. The surfing craft as in claim 1, wherein said fin box is a plurality of fin boxes and said fin is a plurality of fins.

8. The surfing craft as in claim 1, wherein said locking tab is attached to said locking arm, wherein said locking arm is attached to said fin, and wherein said indention is on said fin box.

9. The surfing craft as in claim 1, wherein said locking tab is attached to said locking arm, wherein said locking arm is attached to said fin box, and wherein said indention is on said fin.

10. The surfing craft as in claim 1, wherein said locking tab is attached to said fin, wherein said indention is on said locking arm and wherein said locking arm is attached to said fin box.

11. The surfing craft as in claim 1, wherein said locking tab is attached to said fin box, wherein said indention is on said locking arm and wherein said locking arm is attached to said fin.

12. The surfing craft as in claim 1, wherein said surfing craft is a surfboard.

13. A surfing craft with removable fin, comprising:

A) a surfing craft body means,

B) a fin box means disposed in said surfing craft body means,

C) a removable fin means disposed in said fin box means, and

D) a releasable locking means, comprising
1) a locking tab means,
2) an indention means, and
3) a bendable spring actuated locking arm means, wherein said spring actuated locking arm means is for applying a spring force locking said locking tab means into said indention means, said bendable spring actuated locking arm means comprising:
a. a finger receiving end, and
b. an attached end, wherein said locking tab means is removable from said indention means by pressing said spring actuated locking arm means with a finger means at said finger receiving end causing said bendable spring actuated arm means to bend at said attached end and causing said spring actuated locking arm means to overcome said spring force.

14. The surfing craft as in claim 13, wherein said locking tab means is located on said fin means and said indention means is located on said fin box means.

15. The surfing craft as in claim 13, wherein said locking tab means is located on said fin box means and said indention means is located on said fin means.

16. The surfing craft as in claim 13, wherein said fin box means further comprises a stabilizing tab for better securing said fin box means into said surfing craft body means.

17. The surfing craft as in claim 13, wherein said locking arm means is bendably attached to either one of said fin means or said fin box means.

18. The surfing craft of claim 13, wherein said bendable locking arm means is a pivoting locking arm means and wherein said pivoting locking arm means is pivotally attached to either one of said fin means or said fin box means.

19. The surfing craft as in claim 13, wherein said fin box means is a plurality of boxes and said fin means is a plurality of fins.

20. The surfing craft as in claim 13, wherein said locking tab means is attached to said locking arm means, wherein said locking arm means is attached to said fin means, and wherein said indention means is on said fin box means.

21. The surfing craft as in claim 13, wherein said locking tab means is attached to said locking arm means, wherein said locking arm means is attached to said fin box means, and wherein said indention means is on said fin means.

22. The surfing craft as in claim 13, wherein said locking tab means is attached to said fin means, wherein said indention means is on said locking arm means and wherein said locking arm means is attached to said fin box means.

23. The surfing craft as in claim 13, wherein said locking tab means is attached to said fin box means, wherein said indention means is on said locking arm means and wherein said locking arm means is attached to said fin means.

24. The surfing craft as in claim 13, wherein said surfing craft is a surfboard.

25. A surfing craft with removable fin, comprising:

A) a surfing craft body,

B) a fin box disposed in said surfing craft body,

C) a removable fin disposed in said fin box, and

D) a releasable locking mechanism, comprising
1) a locking tab,
2) an indention, and
3) a bendable spring actuated locking arm, wherein said spring actuated locking arm is for applying a spring force locking said locking tab into said indention, said bendable spring actuated locking arm comprising:
c. a tool receiving end, and
d. an attached end, wherein said locking tab is removable from said indention by pressing said spring actuated locking arm with a tool at said tool receiving end causing said bendable spring actuated locking arm to bend at said attached end and causing said spring actuated locking arm to overcome said spring force.

26. A surfing craft with removable fin, comprising:

A) a surfing craft body means,

B) a fin box means disposed in said surfing craft body means,

C) a removable fin means disposed in said fin box means, and

D) a releasable locking means, comprising
1) a locking tab means,
2) an indention means, and
3) a bendable spring actuated locking arm means, wherein said spring actuated locking arm means is for applying a spring force locking said locking tab means into said indention means, said bendable spring actuated locking arm means comprising:
a. a tool receiving end, and
b. an attached end, wherein said locking tab means is removable from said indention means by pressing said spring actuated locking arm means with a tool means at said tool receiving end causing said bendable spring actuated arm means to bend at said attached end and causing said spring actuated locking arm means to overcome said spring force.

* * * * *